US005628148A

United States Patent [19]

Beutler

[11] Patent Number: 5,628,148

[45] Date of Patent: May 13, 1997

[54] PIN ALIGNING SYSTEM FOR DOORS AND DOOR MOUNTED DEVICES

[76] Inventor: Bruce Beutler, 8 Lakeshore Dr. S., Patterson, N.Y. 12563

[21] Appl. No.: 272,698

[22] Filed: Jul. 8, 1994

[51] Int. Cl.[6] ..... E05B 65/06

[52] U.S. Cl. ..... 49/394; 292/19

[58] Field of Search ..... 49/381, 396, 394, 49/383; 292/162, 147, 204, DIG. 55

[56] References Cited

U.S. PATENT DOCUMENTS

| | | | |
|---|---|---|---|
| 545,277 | 8/1895 | Feinberg | 292/80 |
| 975,675 | 11/1910 | Bumiller . | |
| 1,102,855 | 7/1914 | Becker . | |
| 1,134,907 | 4/1915 | Re . | |
| 1,545,962 | 7/1925 | Klein . | |
| 1,654,163 | 12/1927 | Evans . | |
| 1,758,620 | 5/1930 | Rebori . | |
| 2,680,368 | 6/1954 | McKittick . | |
| 3,095,225 | 6/1963 | Domsic et al. | 49/394 X |
| 3,334,501 | 8/1967 | Greenwald . | |
| 3,436,860 | 4/1969 | James | 292/147 X |
| 3,636,659 | 1/1972 | Bylicki | 49/383 |
| 4,069,618 | 1/1978 | Geiss | 49/483.1 |
| 4,133,142 | 1/1979 | Dzus | 292/19 X |
| 4,314,157 | 2/1982 | Gaines . | |

*Primary Examiner*—Kenneth J. Dorner
*Assistant Examiner*—Jerry Redman
*Attorney, Agent, or Firm*—Nolte, Nolte and Hunter, P.C.

[57] ABSTRACT

A guide pin and conical guide pin receptor for aligning a door relative to a door frame or other stable grounded device. The pin and receptor align the door from horizontal misalignment and radially throughout 360° relative to the axis of the pin receptor. In aligning the door, interfitting elements on the door and door frame are aligned including such elements as comprise key actuated interlocking switch systems.

9 Claims, 2 Drawing Sheets

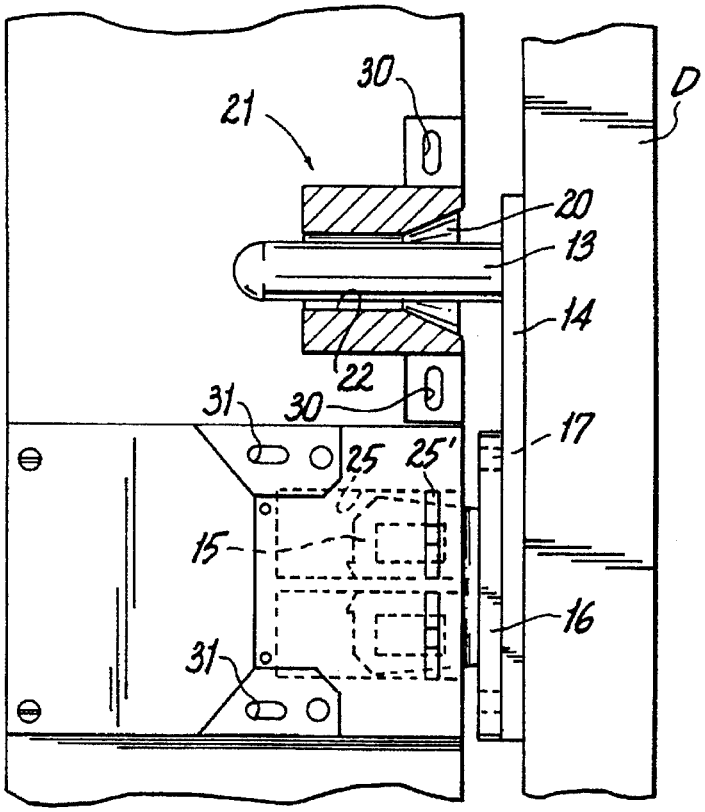
Fig. 5
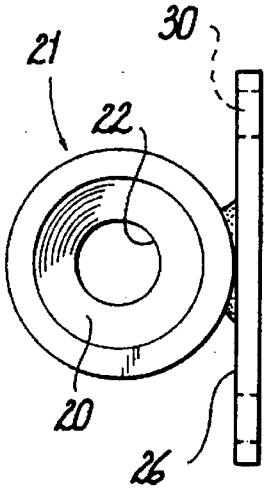
Fig. 4
Fig. 6
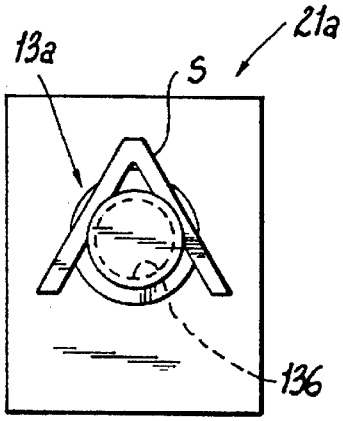
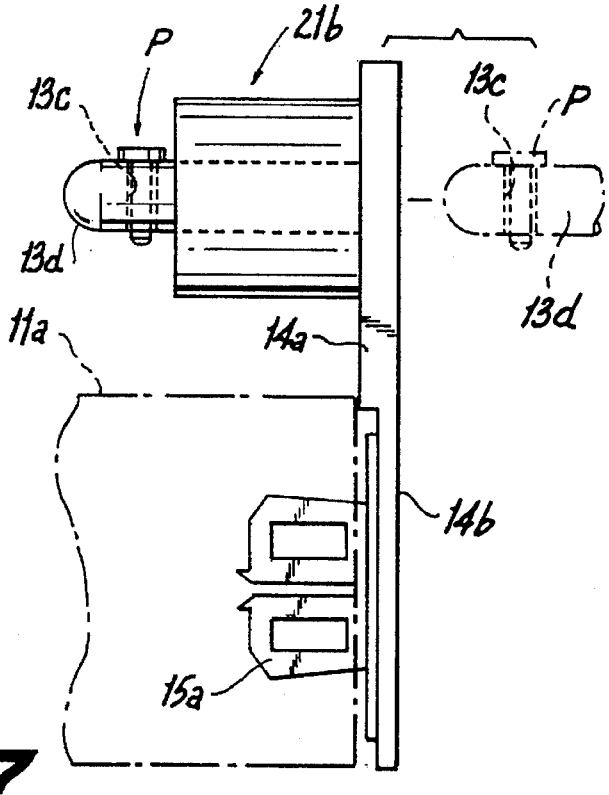
Fig. 7

PIN ALIGNING SYSTEM FOR DOORS AND DOOR MOUNTED DEVICES

FIELD OF INVENTION

This invention relates to apparatus for precisely aligning hinged doors within door frames and, more particularly, for aligning devices supported on such doors in precise juxtaposed relation with mating devices supported adjacent the door. The invention has particular application to the provision of a bracket incorporating a rounded guide pin that mates with a conical guide pin receptor to align a door and consequently a thin insert, such as key, with an insert receptor or key slot. In this respect, the invention relates to such a guide pin and receptor which aligns a key with a key actuated electrical interlocking switch by aligning the entry door to a work place having machinery operatively connected in electrical circuit with the electrical interlocking switch.

BACKGROUND OF THE INVENTION AND DESCRIPTION OF THE PRIOR ART

Conventional door aligning devices, such as disclosed in U.S. Pat. No. 1,654,163 only correct the vertical misalignment of a door and have been limited in their use, since such devices have to be mounted and recessed into the edge of the door and door frame to be effective.

In prior installations of flat key and slotted interlocking switches, to which the alignment device of the invention is particularly applicable, the problem has persisted in that, with use, doors become misaligned because of warpage and/or because of the weight upon their hinged connections. When this occurs, the mating of the thin key with the thin slot of the key actuated electrical switch is prevented. The invention, in this respect, is important to the protection of those who work in plants with machinery within enclosures that must shut down when the enclosure is opened to permit servicing of the machinery. The switch closes the circuit that delivers electrical power to machinery within an enclosed work area when the door is in the closed position and the key inserted in the switch slot and opens the circuit when the key is withdrawn when the door is opened.

It is a broad object therefore of the invention to provide a means for correcting the alignment of a misaligned door. It is a specific object of the invention to provide such means in conjunction with devices that are mated upon the closing of a door. Very specifically, the invention contemplates the alignment of key actuated interlock systems.

SUMMARY OF THE INVENTION

The present invention is in guiding apparatus assuring the alignment of a hinged door relative to a stable support adjacent the door, such as a door jamb. The invention comprises a rounded guide pin which, when a door is moved to the closed position, enters a conical shaped pin receptor thereby assuring both vertical and lateral correction and consequently the alignment of male/female mating apparatus supported on the door and jamb; as for example a flat key and slotted interlocking switch.

The guiding apparatus of the present invention is mounted on the face of the door and the face of the door frame, thereby not requiring a recessed mounting and permitting the apparatus to be mounted conveniently on all types of doors, diminishing the hazards presented when a guide pin is mounted to a door which could potentially catch or hit the operator.

Furthermore, and importantly, since the aligning apparatus of the invention is not constrained within the edges of the door and frame, it can be easily sized to accommodate any door size. Thus, the invention can be proportional to the size and weight of the door so as to sustain the forces attending the alignment of the door.

The alignment device of the present invention was conceived to function in conjunction with an interlock safety switch to assure the alignment of a door before the key's entry into the key actuated electrical switch which activates machinery within the enclosed work area. In this respect, a rounded guide pin, which is mounted adjacent the key, is of a length to mate with the conical shaped guide pin receptor, which is mounted adjacent the key actuated electrical switch, prior to the mating of the key with the key actuated electrical switch. When the door is open, the key and the key actuated electrical switch are separated, opening the circuit and causing the electrical switch to transmit a "door open" signal to deactivate the machinery within the enclosed work area. When the door is closed and the key enters the key actuated electrical switch to close the circuit, a "door closed" signal is transmitted activating the machinery within the enclosed work area.

While it is believed the invention has broad application to aligning hinged doors, the invention will be described as it relates to aligning doors for the purpose of aligning devices which mate when the door is closed; specifically key actuated interlock systems.

In this last respect, the guide and key elements of the invention may be mounted either on the door or on the door jamb. Similarly, the guide receptor and key receptor may be mounted on the door or on the door jamb. In the description which follows, for convenience, the guide and key are both mounted on the door.

The guiding apparatus of the present invention comprises a rounded guide pin which mates with a conical guide pin receptor. In a preferred embodiment of the invention, the rounded guide pin is mounted on a bracket which in turn is mounted on the broad face of the door. The guide pin has been positioned to mate with a conical guide pin receptor which has been mounted on a stable support as for example, the door jamb, and is positioned to receive the guide pin as the door is closed.

Similarly, in a specific embodiment of the invention a key mount is affixed to the bracket adjacent the rounded guide pin and mates with the key actuated electrical switch that is affixed on the door frame adjacent the conical guide pin receptor. As the door is moved from the opened position to the closed position, the rounded guide pin is sized to mate with the conical guide pin receptor prior to the mating of the key with the key actuated electrical switch.

The invention also generates accessory devices in which the guide pin and receptor of the invention functions as door hold or locking elements as well as a door over travel deterrent.

DESCRIPTION OF THE DRAWINGS

FIG. 4 is a diagrammatic elevational view of the pin receptor of FIG. 2; and

FIG. 5 is a diagrammatic view of the bracket and switch of FIG. 2 in the closed position; and FIG. 6 is a schematic plan view of a modified guide pin of the invention; and FIG. 7 is a schematic elevational view of a modified guide pin and bracket of the invention.

DESCRIPTION OF THE PREFERRED EMBODIMENT

Figure 1:
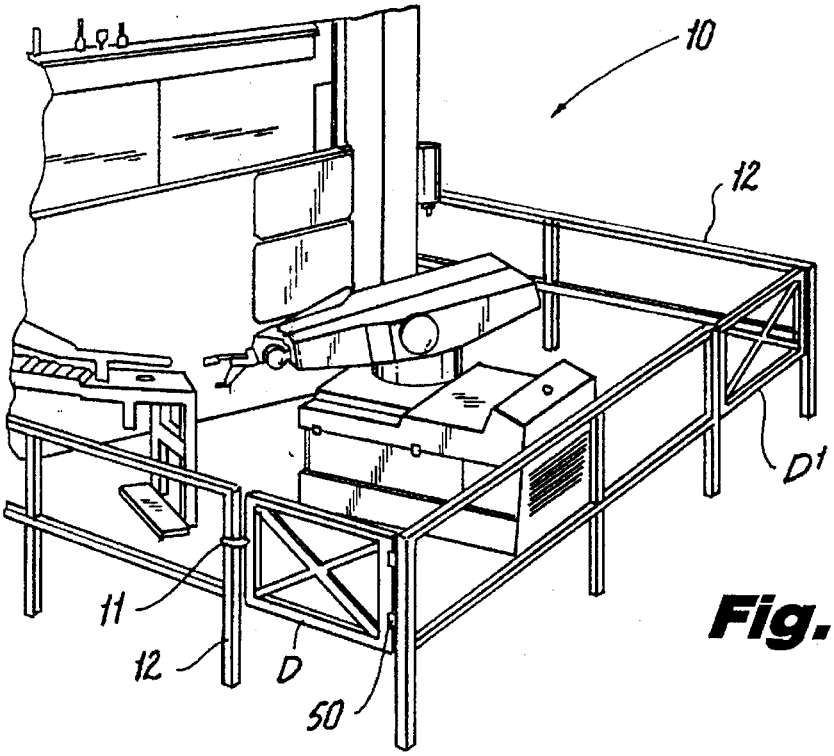
FIG. 1 is a schematic perspective view of a plant layout having electrically powered machinery within an enclosure.

In FIG. 1 there is shown a plant layout 10 in which various electrically powered machinery, including a robot, a press and a stock conveyor are enclosed within a fixed barrier 12. Entry to the machinery is permitted only through doors D and $D^1$ hinged as at 50. The plant here under consideration, is fully automatic and does not require the presence of an operator. Furthermore, should access to the plant be required to service the machinery, for example, it would be dangerous for a person to be in the area while the machinery is operating.

Therefore, start up and shut down of the automated machinery in the plant is controlled by an electrical interlocking safety switch 11 mounted on the fixed barrier 12, in this instance the door jamb.

Guide pin 13 is secured to guide bracket 14 which has been extended to provide space to mount key 15 which in this instance is secured to its own mounting plate 16. The plate is normally secured to the door but here it is secured to the guide bracket via mounting holes 17. The guide bracket is secured to the door D by any conventional means.

As the door closes, the hemispherical leading end of the rounded guide pin is guided by the conical receiving aperture 20 of guide pin receptor 21 into the retention channel 22 of the receptor. In that position, the two sections of bifurcated key actuator 15 is aligned with the slots of key aperture 25 (shown in phantom in FIG. 2) opening at the front surface 27 of electrical interlocking switch 11.

A number of key receptor slotted apertures, 25 and 25' of which are shown, are provided in the switch for alternate mounting.

Figure 2:
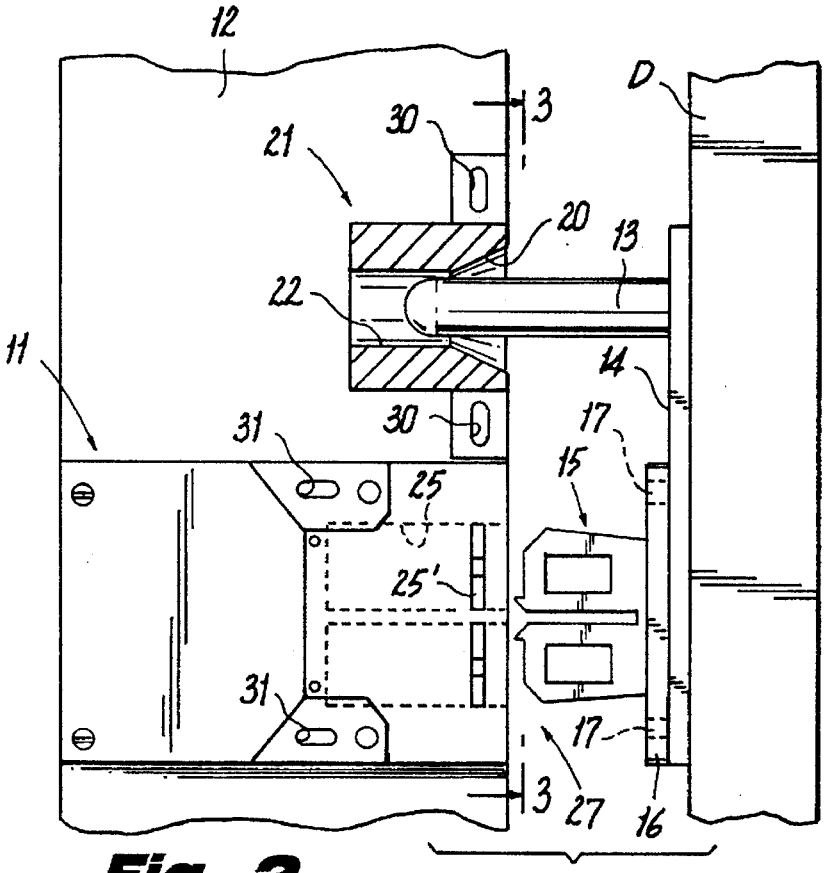
FIG. 2 is a diagrammatic side elevational view of a guide pin bracket made in accordance with the invention, incorporating a key actuator and mounted on a door; and of a safety interlock switch mounted on a door jamb with a guiding pin receptor, formed in accordance with the invention mounted adjacent the switch.
Figure 3:
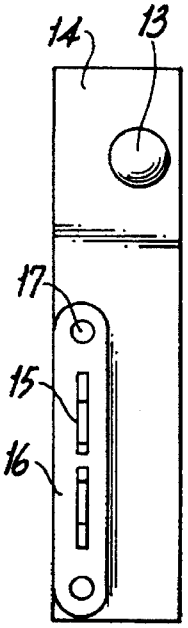
FIG. 3 is a diagrammatic side plan view of the guide pin bracket taken along the line 3—3 of FIG. 2.

In the construction of FIGS. 2–4, the body of guide pin receptor is welded to its mounting plate 26 which provides mounting holes 30 for separately mounting the receptor to the door jamb. The key actuated electrical interlocking switch 11 is mounted to the jamb through mounting holes 31.

In operation, when the door is closed, as shown in FIG. 5, the guide pin and key mate in the retention channel and key slots respectively. The key, upon entering the key slots closes the circuit which supplies electricity to the machinery. When the door is opened, the key 12 withdraws from the switch 13 and opens the circuit which otherwise supplies electricity to the machinery.

As noted, the receiving aperture 20 of the guide pin receptor is conical and therefore adapted to receive the hemispherical leading end of the guide pin 13 in all directions radial to the axis of the aperture, and to guide the pin into the retention channel 22 which disposes the key 15 in precise alignment with the slots of key aperture 25. The length of the guide pin has been calculated to assure entry of its leading end into the retention channel before the key enters the slot by the action of the door closing.

The key actuated safety interlock switch of FIGS. 2–4 is typified by the E.E. Controls industrial switch gear model AZ16ZVR series produced by Schmersal of Wuppertal, Germany.

Various accessories are also available for the alignment device of the invention. For example, in FIG. 6, the guide pin **13*a* has an annular groove 136 into which the legs of a "V" shaped spring S snap when the pin extends past the rear face of receptor 21*a***. The spring is secured to the receptor by any conventional means. In order to open the door, the spring resistance has to be overcome.

Another accessory is a lockout pin, shown in FIG. 7 at P, which can be used to prohibit a door from either opening or closing. When access to the interior side of the closed door is had, as in the plant layout of FIG. 1, the pin P is placed through pin hole **13*c* at the end of guide pin 13*d*** when the door is closed and the machinery is operating. Whether or not access to the interior side of the door is had, the pin P is placed in the pin hole when the guide pin is removed from the receptor and then acts to prevent the door from closing and thus accidentally starting up the machinery.

The alignment device of the invention also provides the advantage of a door end stop device thereby protecting the fragile electrical interlock switch from door over travel. This construction is shown in FIG. 7, where the guide pin **13*d* is mounted on a raised portion 14*a* of bracket 14*b*, thereby preventing door over travel yet permitting entry of the key 15*a* into switch 11*a* as the raised portion meets the forward surface of receptor 21*b*** to inhibit further movement of the door in the closed position.

The inventions disclosed herein are not limited to the specific embodiments but rather to the spirit and scope of the following claims.

I claim:

1. Aligning apparatus aligning a door having flat outer and inner surfaces extending between side edge surfaces relative to a door frame having a vertical surface with a horizontal width extending normal to the outer and inner surfaces of the door said door being movable from and to an open position with respect to the door frame and from and to a closed position with respect to the door frame, said aligning apparatus comprising a guide pin having a round cylindrical body extending along a center axis and having a free distal leading end hemispherical in all radial directions from said guide pin center axis, a guide pin bracket extending along a center axis, said guide pin having a proximal end secured on said guide pin bracket with said center axis of said guide pin extending normal to said center axis of said guide pin bracket, a guide pin receptor having a truncated cone shaped entry end surface and a round cylindrical pin receptor channel communicating with and extending along a center axis from the apex of said truncated cone shaped entry end surface, means for mounting said guide pin bracket and said guide pin receptor on the door and the door frame in juxtaposed position with said guide pin in said guide pin receptor channel when the door is in the closed position, said pin distal end and said truncated cone shaped entry end surface of said receptor constituting guiding means when the door is moved from the open position to the closed position for guiding the door from misalignment in all radial directions to alignment with the axes of said pin and channel in substantial superimposed alignment.

2. The apparatus of claim 1 wherein said guide pin bracket is mounted on one of said inner and said outer surfaces of said door and said guide pin receptor is mounted on said vertical surface of said frame.

3. The apparatus of claim 1 wherein said guide pin receptor is secured to a guide pin receptor bracket and said guide pin receptor bracket is mounted on one of said vertical surface of said frame and on one of said inner and said outer surfaces of said door.

4. The apparatus of claim 3 further comprising first and second interfitting means;

said first interfitting means and said guide pin receptor being mounted adjacent one another on said guide pin receptor bracket.

5. The apparatus of claim 4 wherein said second interfitting means is mounted on said guide pin bracket adjacent said guide pin.

6. The apparatus of claim 5 wherein said first and second interfitting means mate when said door is in the closed position and said guide pin extends within said channel and said guide pin axis and said channel axis are aligned.

7. The apparatus of claim 6 wherein said first interfitting means comprises key means for interfitting with said second interfitting means and said second interfitting means comprises key actuated switch means for interfitting with said first interfitting means.

8. The apparatus of claim 4, wherein said guide pin receptor and said guide pin bracket comprise means for stopping closing movement of said door when said first and second interfitting means mate.

9. The apparatus of claim 1 wherein said guide pin and said guide pin receptor include cooperating means for inhibiting axial movement of said guide pin relative to said guide pin receptor.

* * * * *